US008862004B2

(12) United States Patent
Maruyama et al.

(10) Patent No.: US 8,862,004 B2
(45) Date of Patent: Oct. 14, 2014

(54) IMAGE FORMING APPARATUS INCLUDING CHARGERS AND A CURRENT DETECING UNIT THAT DETECTS A SUM OF CURRENTS OF THE CHARGERS

(75) Inventors: Tsuyoshi Maruyama, Nagoya (JP); Masahito Hamaya, Nagoya (JP); Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 209 days.

(21) Appl. No.: 13/194,075

(22) Filed: Jul. 29, 2011

(65) Prior Publication Data

US 2012/0027437 A1 Feb. 2, 2012

(30) Foreign Application Priority Data

Jul. 29, 2010 (JP) ..... 2010-170941

(51) Int. Cl.
*G03G 15/02* (2006.01)
*G03G 15/01* (2006.01)

(52) U.S. Cl.
CPC ..... *G03G 15/0283* (2013.01); *G03G 15/0194* (2013.01)
USPC ..... 399/50; 399/100

(58) Field of Classification Search
USPC ..... 399/100, 89, 88, 90, 128, 171, 50
See application file for complete search history.

(56) References Cited

U.S. PATENT DOCUMENTS

| | | | | |
|---|---|---|---|---|
| 5,572,295 | A | 11/1996 | Sakagami et al. | |
| 6,345,159 | B1 * | 2/2002 | Suzuki | 399/50 |
| 2007/0147858 | A1 * | 6/2007 | Inukai | 399/31 |
| 2008/0247782 | A1 * | 10/2008 | Sato et al. | 399/171 |
| 2009/0010661 | A1 * | 1/2009 | Hamaya | 399/37 |
| 2010/0080593 | A1 * | 4/2010 | Inukai et al. | 399/50 |

FOREIGN PATENT DOCUMENTS

| | | | | |
|---|---|---|---|---|
| JP | 03089264 A * | 4/1991 | | G03G 15/02 |
| JP | 03-142483 | 6/1991 | | |
| JP | 03142483 A * | 6/1991 | | G03G 15/01 |
| JP | 04-003178 | 1/1992 | | |
| JP | 05-323773 | 12/1993 | | |
| JP | 07-244420 | 9/1995 | | |
| JP | 08-054768 | 2/1996 | | |

* cited by examiner

*Primary Examiner* — Clayton E Laballe
*Assistant Examiner* — Victor Verbitsky
(74) *Attorney, Agent, or Firm* — Banner & Witcoff, Ltd.

(57) ABSTRACT

An image forming apparatus, includes: at least one photosensitive element; a plurality of chargers configured to charge the at least one photosensitive element; a voltage applying circuit commonly connected to the plurality of chargers and configured to apply a voltage to the plurality of chargers; a current detecting unit configured to detect a current sum of current that flows to the plurality of chargers from the voltage applying circuit; and a control device configured to control the voltage applying circuit so that the current sum detected by the current detecting unit becomes equal to or larger than a reference value.

12 Claims, 12 Drawing Sheets

IMAGE FORMING APPARATUS INCLUDING CHARGERS AND A CURRENT DETECING UNIT THAT DETECTS A SUM OF CURRENTS OF THE CHARGERS

This application is based upon and claims the benefit of priority of Japanese Patent Application No. 2010-170941 filed on Jul. 29, 2010, the contents of which are incorporated herein by reference in its entirety.

BACKGROUND

The present disclosure relates to an image forming apparatus.

Multi-color image forming apparatuses such as a color laser printer include a charger provided for each of developer colors (e.g., yellow, magenta, cyan, and black). Generally, reduction in the number of components and miniaturization of the apparatuses are sought by sharing a high-voltage power supply unit (e.g., a voltage applying circuit) applying high voltage to each charger in the above type of image forming apparatuses.

SUMMARY

A discharge amount of a charger decreases as the charger is being increasingly contaminated. Therefore, the charge amount of a photosensitive element becomes short, thereby an image quality may deteriorate. In order to prevent the image quality from being deteriorated due to the shortage of the charge amount of the photosensitive element, an amount of current may be controlled by detecting current that flows from a voltage applying circuit to each of the chargers. However, in this case, a current detecting unit needs to be provided in each charger, and as a result, the number of components increases.

The present disclosure has been made in an effort to solve the problem and one of the aspects of the present disclosure is intended to suppress the deterioration of the image quality through a configuration with minimum circuit components in an image forming apparatus in which the voltage applying circuit is being shared.

According to the aspect of the disclosure, there is provided an image forming apparatus, comprising:

at least one photosensitive element;

a plurality of chargers configured to charge the at least one photosensitive element;

a voltage applying circuit commonly connected to the plurality of chargers and configured to apply a voltage to the plurality of chargers;

a current detecting unit configured to detect a current sum of current that flows to the plurality of chargers from the voltage applying circuit; and a control device configured to control the voltage applying circuit so that the current sum detected by the current detecting unit becomes equal to or larger than a reference value.

DESCRIPTION OF EXEMPLARY EMBODIMENTS

First Exemplary Embodiment

The first exemplary embodiment of the present disclosure will be described with reference to FIGS. 1 to 6.

1. Overall Configuration of Printer

Figure 1:
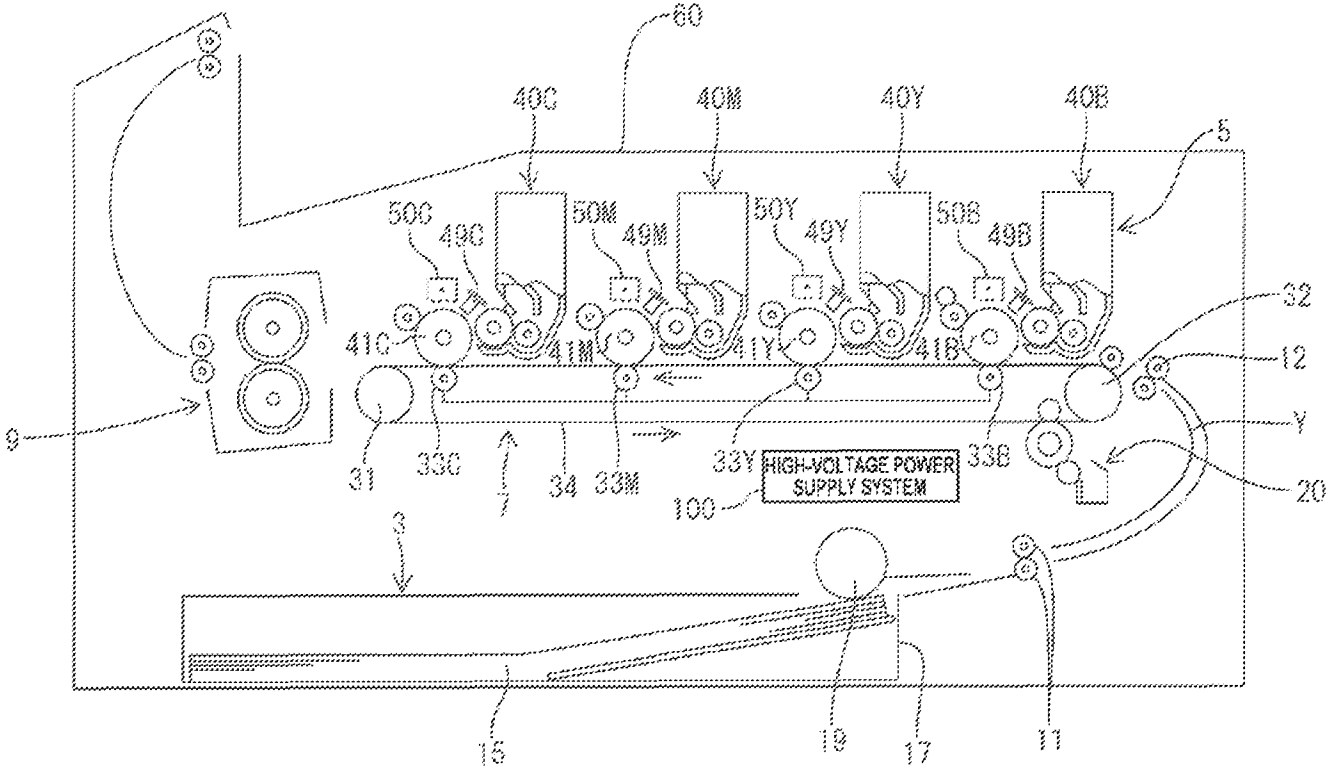
FIG. 1 is a schematic cross-sectional view showing an internal configuration of a printer according to a first exemplary embodiment of the present disclosure.

FIG. 1 is a schematic cross-sectional view showing an internal configuration of a printer 1 which is an image forming apparatus according to the exemplary embodiment of the present disclosure. In a description provided below, in the case in which the respective components are distinguished from each other by each color, suffixes of B (black), Y (yellow), M (magenta), and C (cyan) are attached to reference numerals of the components, whereas in the case in which the components are not distinguished from each other, the suffixes are omitted.

The printer 1 includes a feeding unit 3, an image forming unit 5, a transporting mechanism 7, a fixing unit 9, a belt cleaning mechanism 20, and a high-voltage power supply device 100.

A feeding unit 3 is formed at a lowermost part of printer 1 and includes a tray 17 receiving sheets 15 (e.g., papers and OHP sheets) and a pickup roller 19. Sheets 15 received in tray 17 is taken out one by one by a pickup roller 19 and sent to a transporting mechanism 7 through a transporting roller 11 and a registration roller 12.

A transporting mechanism 7 transports paper sheets 15 and is provided over the feeding unit 3 in the printer 1. The transporting mechanism 7 includes a driving roller 31, a driven roller 32, and a belt 34. A belt 34 is bridged between a driving roller 31 and a driven roller 32. When the driving roller 31 rotates, the surface of belt 34 facing a photosensitive drum 41 moves from a right direction to a left direction in FIG. 1. As a result, sheets 15 sent from the registration roller 12 are transported toward under the image forming unit 5.

In the belt 34, four transfer rollers 33B, 33Y, 33M, and 33C are provided to correspond to the four photosensitive drums 41B, 41Y, 41M, and 41C, respectively. The transfer rollers 33 are disposed to face the photosensitive drums 41B, 41Y, 41M, and 41C with the belt 34 interposed therebetween, respectively.

An image forming unit 5 includes four process units 40B, 40Y, 40M, and 40C and four exposure devices 49B, 49Y, 49M, and 49C. The Process units 40B, 40B, 40M, and 40C are arranged in series in a transport direction of the sheets 15 (e.g., a horizontal direction of FIG. 1).

The process units 40 have the same structure and include the photosensitive drums for respective colors 41B, 41B, 41M, and 41C (e.g., a 'photosensitive element' of the present disclosure), a toner case 43 receiving a toner of each color (e.g., a non-magnetic positively-charged mono-component toner), a development roller 45, and chargers 50B, 50Y, 50M, and 50C.

In each of the photosensitive drums 41B, 41B, 41M, and 41C, for example, a positively-charged photosensitive layer is formed on a substrate made of aluminum and the aluminum substrate is connected to a ground of printer 1.

A development roller 45 is disposed to face a feeding roller 46 under a toner case 43 and serves to feed the toner onto the photosensitive drums 41B, 41B, 41M, and 41C as a uniform thin layer by frictionally charging the toner to positive polarity by friction accompanied by rotation when the toner passes between the development roller 45 and the feeding roller 46.

Figure 2:
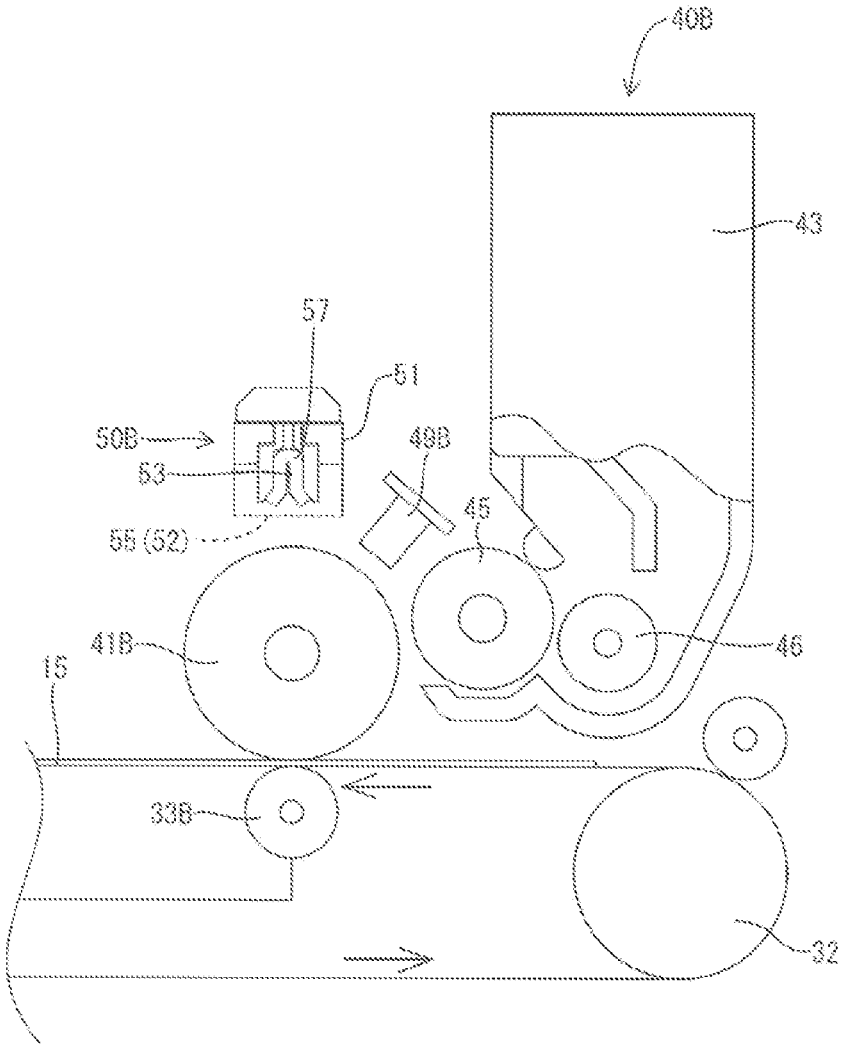
FIG. 2 is a diagram showing the structure of a process unit.
Figure 3:
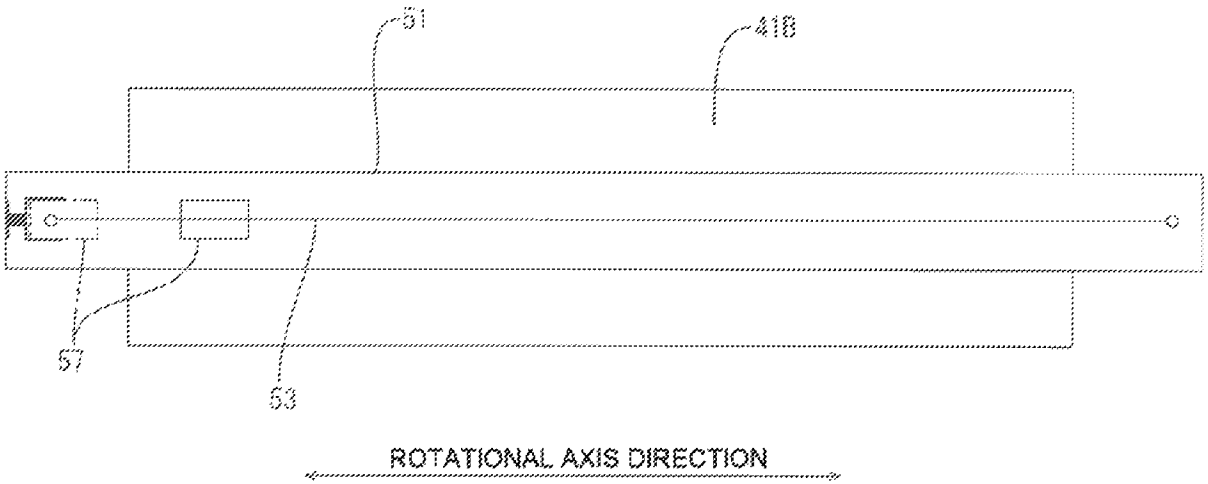
FIG. 3 is a diagram showing the structure of a charger.

Each of the chargers 50B, 50Y, 50M, and 50C is a Scorotron type charger and includes a shield case 51, a wire 53, and a metallic grid electrode 55 as shown in FIGS. 2 and 3. The shield case 51 has a rectangular cylindrical shape which elongates in a rotational axis direction of the photosensitive drum 41. A surface of the shield case 51 facing to the photosensitive drum 41 is opened to form a discharge port 52.

The wire 53 is made of, for example, a tungsten wire. The wire 53 extends in a rotational axis direction (e.g., a horizontal direction of FIG. 3) in shield case 51 and high voltage is applied to wire 53 by a voltage applying circuit 200 to be described below. The wire 53 causes a corona discharge in the shield case 51 by the application of high voltage. In addition, ions generated by the corona discharge flows from the discharge port 52 to the photosensitive drum 41 as a discharge current to uniformly charge the surface of the photosensitive drum 41 to the positive polarity.

A plate-like grid electrode 55 having a slit or a through-hole is attached to the discharge port 52 of the shield case 51. Voltage is applied to the grid electrode 55 and the applied voltage is controlled and thereby controls charged voltage of the photosensitive drum 41.

A wire cleaner 57 (e.g., a 'cleaning unit' of the present disclosure) is provided in the chargers 50B, 50Y, 50M, and 50C. The wire cleaner 57 is configured to be slidably movable along the wire 53. An operator reciprocates the wire cleaner 57 along the wire 53 to remove contaminants of the wire 53.

Each of the exposure devices 49B, 49Y, 49M, and 49C includes for example, a plurality of light emitting elements (e.g., LEDs or laser light sources) arrayed in series in the rotation axis direction of the photosensitive drums 41B, 41Y, 41M, and 41C and emits light according to image data inputted from the outside and thereby to form an electrostatic latent image on the surface of each of the photosensitive drums 41B, 41Y, 41M, and 41C.

A series of image forming processes by the laser printer 1 configured as described above will be described in brief below. When the printer 1 receives print data D (see, e.g., FIG. 6), the printer 1 starts print processing. As a result, the surface of each of the photosensitive drums 41B, 41Y, 41M, and 41C is uniformly charged to be the positive polarity by each of the chargers 50B, 50Y, 50M, and 50C according to its rotation. A laser beam is irradiated to each of the photosensitive drums 41B, 41Y, 41M, and 41C from each exposure device 49. As a result, in the case of the surface of each of the photosensitive drums 41B, 41Y, 41M, and 41C, a potential drops at a portion of the surface of each of the photosensitive drums 41B, 41Y, 41M, and 41C that have a predetermined electrostatic latent image depending on the print data, that is, are uniformly charged positive to which the laser beam is irradiated.

Subsequently, by the rotation of the development roller 45, the toner that is adhered to the development roller 45 and positively charged is supplied to the electrostatic latent image formed on the surface of each of photosensitive drums 41B, 41Y, 41M, and 41C. As a result, the electrostatic latent image of each of the photosensitive drums 41B, 41Y, 41M, and 41C becomes a visualized image, such that a toner image by reversal development is formed on the surfaces of the photosensitive drums 41B, 41Y, 41M, and 41C.

Concurrently with the processing for forming the toner image described above, the processing for transporting the sheets 15 is performed. That is, sheets 15 are delivered to a paper transport path Y from tray 17 one by one by the rotation of pickup roller 19. The sheets 15 conveyed to paper transport path Y is transported to a transfer location (e.g., a point where photosensitive drum 41 and transfer roller 33 contact each other) by the transport roller 11 and the belt 34.

Therefore, when the sheets 15 pass through the transfer location, the toner image (e.g., a developer image) of each color formed on the surface of each photosensitive drum 41 is sequentially superposed and transferred on the surfaces of the sheets 15 by the transfer bias applied to each transfer roller 33. Therefore, the toner images (e.g., developer images) of the colors are formed on the sheets 15. Thereafter, when the sheets 15 pass through the fixing unit 9 provided in the rear side of belt 34, the transferred toner image (e.g., a developer mage) is thermally fixed and sheets 15 are ejected onto an ejection tray 60.

2. Configuration of High-Voltage Power Supply Device 100

A high-voltage power supply device 100 includes a voltage applying circuit 200, a constant-voltage circuit 250, a current detecting unit 260, and a control device 110.

A voltage applying circuit 200 includes a PWM signal smoothing circuit 210, a trans-drive circuit 220, an output circuit 230, and a voltage detecting circuit 240 and serves to apply high voltage of approximately 6 kV to 7 kV to each charger 50. The PWM signal smoothing circuit 210 smoothes a PWM signal S1 outputted from a PWM port A of the control device 110 and outputs the smoothed signal to the trans-drive circuit 220. The trans-drive circuit 220 is constituted by for example, an amplification element such as a transistor and applies primary voltage of a level depending on a duty ratio of PWM signal S1 to a primary winding to a transformer Tr.

An output circuit 230 includes a boosting circuit constituted by a transformer Tr and a smoothing circuit 235 constituted by a diode D and a condenser C, and boosts up the primary voltage inputted from the trans-drive circuit 220 and thereafter, rectifies and outputs the primary voltage that is boosted up. In addition, the wire 53 of each of the chargers 50B, 50Y, 50M, and 50C is commonly connected to an output line Lo of the output circuit 230. As a result, the output voltage Vo of the output circuit 230 is applied to the wire 53 of each of the chargers 50B, 50Y, 50M, and 50C.

An auxiliary wire 231 is provided in the transformer Tr of the output circuit 230. Voltage of a level depending on secondary voltage of the transformer Tr is generated in an auxiliary wire 231.

The voltage detecting circuit 240 detects the voltage generated in the auxiliary wire 231 and inputs the detected voltage into an A/D port P1 of the control device 110. As a result, data of secondary voltage of the transformer Tr is received in the control device 110.

Figure 4:
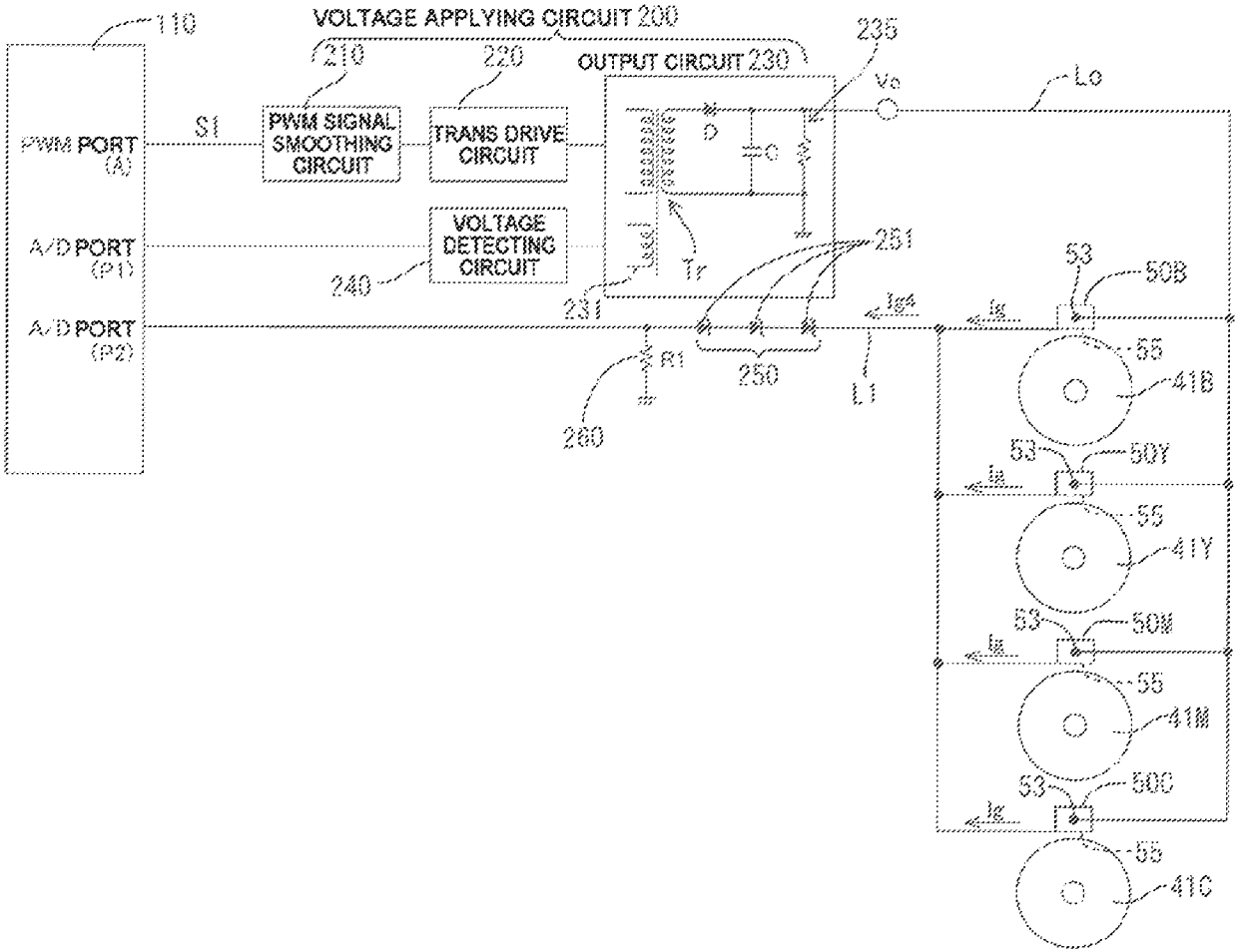
FIG. 4 is a block diagram showing an electrical configuration of a high-voltage power supply device.

As shown in FIG. 4, the grid electrode 55 of each of the chargers 50B, 50Y, 50M, and 50C is connected to a ground GND through a common connection line L1 in the exemplary embodiment. In addition, the constant-voltage circuit 250 and the current detecting unit 260 are provided on the common connection line L1.

The constant-voltage circuit 250 is constituted by three constant-voltage elements (e.g., zener diodes) 251 that are connected in series, and allows the voltage of the grid electrode 55 of each of the chargers 50B, 50Y, 50M, and 50C to be a constant voltage that amounts to a voltage value produced by multiplying breakdown voltage by 3 (e.g., 250 V×3) per one zener diode.

The current detecting unit 260 is constituted by a first resistor R1 connected with the constant-voltage circuit 250 in series and connected to the ground GND. A connection point of the first resistor R1 with the constant-voltage circuit 250 is connected to an A/D port P2 provided in the control device 110 through a signal line. According to this configuration, voltage which is in proportion to a magnitude of current (e.g., sum Ig4 of grid currents Ig of four chargers 50) that flows on the connection line L1 is inputted into each A/D port P2. As a result, by reading the input voltage level, the magnitude of current sum Ig4 of grid currents Ig of the four chargers 50 can be detected in control device 110.

A control device 110 controls an output of the voltage applying circuit 200 and includes PWM port A and two A/D ports P1 and P2. The control device 110 can be configured to include a CPU provided therein and configured with an application specific integrated circuit (ASIC). The control device 110 incorporates a nonvolatile storage unit (not shown) and stores various data (e.g., data of (a) to (c) to be described below) for executing an output control flow to be described hereinafter, in the nonvolatile storage unit.

(a) Data of a reference value of current sum Ig4 of grid currents Ig of the four chargers 50 (e.g. 1 mA).

(b) Data of a target value of output voltage Vo of the voltage applying circuit 200 (e.g., 6 kV).

(c) Data of an upper limit of output voltage Vo of the voltage applying circuit 200 (e.g., 7.5 kV).

It is known that grid current Ig is substantially in proportion to the discharge current If (e.g., see FIG. 8 of the second exemplary embodiment) that flows to photosensitive drum 41 from charger 50, and the grid current Ig serves as an index representing a level of discharge current If that flows on photosensitive drum 41. That is, when the grid current Ig flows with a reference value, 250 μA, discharge current If that flows on the photosensitive drum 41 exceeds a target level. In the exemplary embodiment, 1 mA which is a value produced by multiplying the reference value of the grid current Ig, 250 μA by 4 is set as the reference value of the current sum Ig4 of the grid currents Ig.

Figure 5:
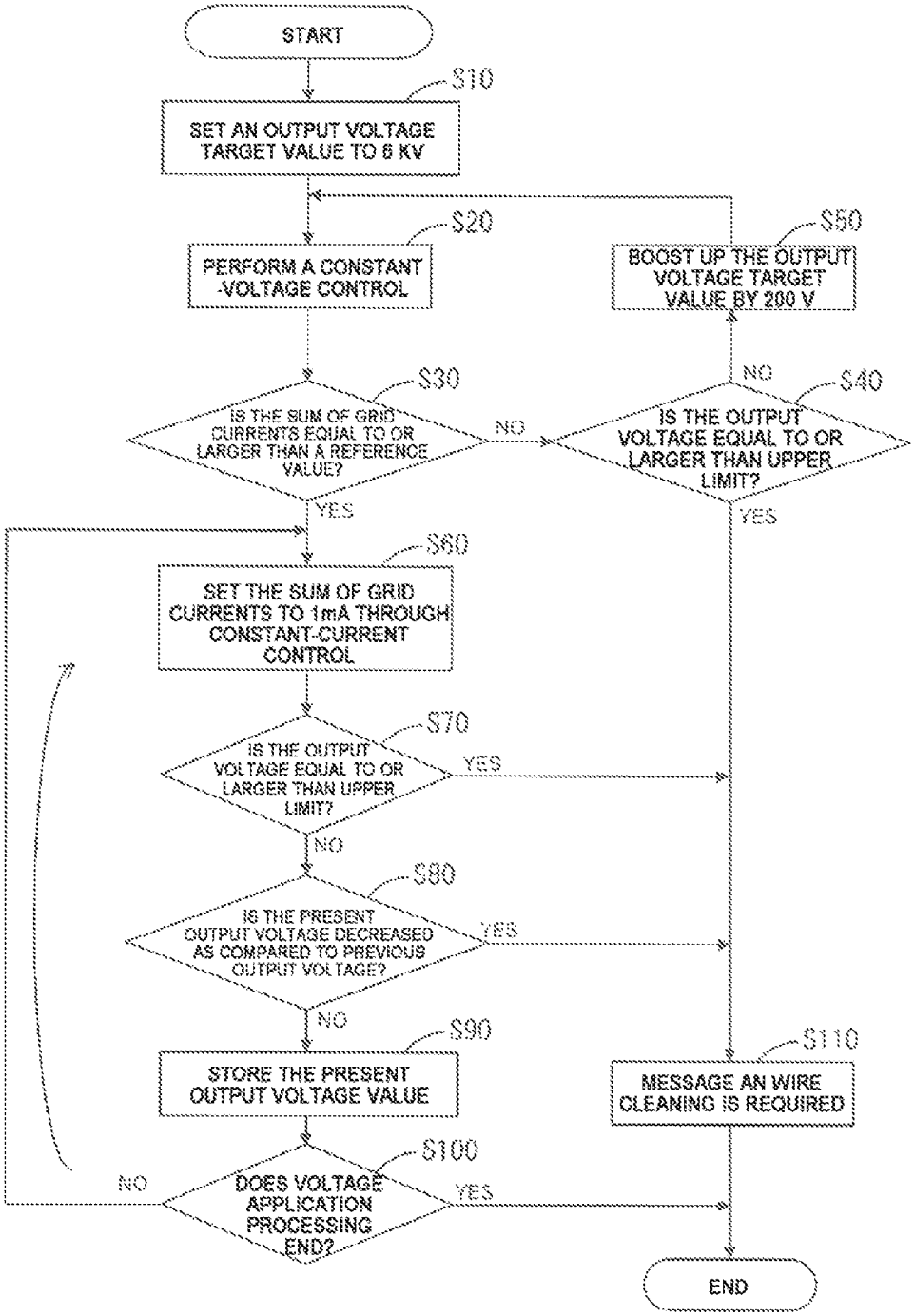
FIG. 5 is a diagram showing an output control flow of a voltage applying circuit.

Subsequently, referring to FIG. 5, the output control flow of the voltage applying circuit 200 executed by the control device 110 will be described. The output control flow of the voltage applying circuit 200 is constituted by a two-step control including an initial control (e.g., a constant-voltage control: steps S10 to S50) executed right after print processing starts and a main control (e.g., a constant-current control: steps S60 to S120) executed until print processing ends after the initial control.

Initial Control: Constant-Voltage Control

Figure 6:
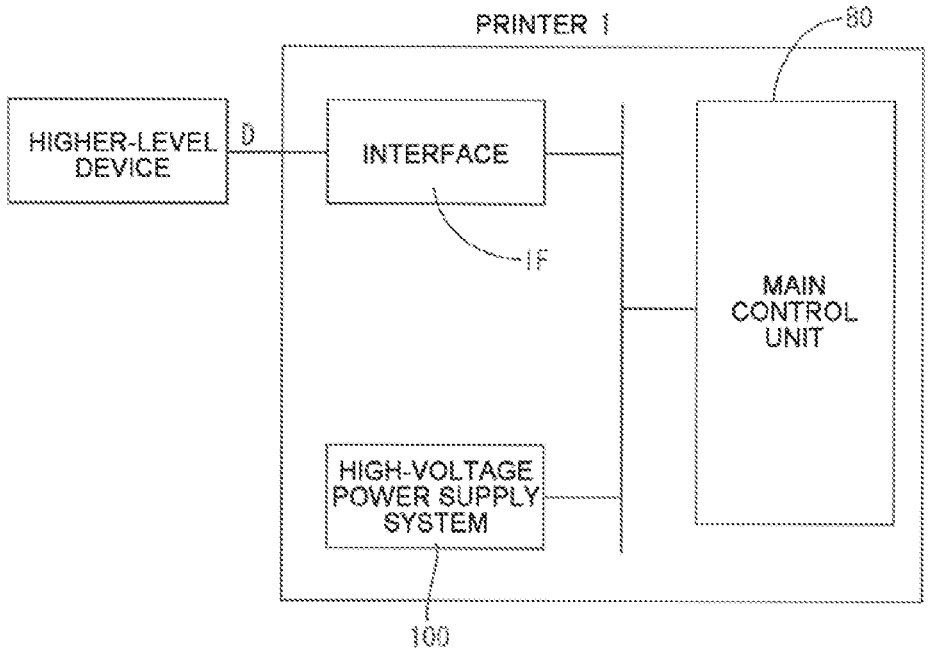
FIG. 6 is a block diagram showing an electrical configuration of a printer.

As shown in FIG. 6, when the print data D is outputted from a higher-level device such as a host computer, the print data D is received in the printer 1 through an interface IF. Then, a print processing start command is given to the control device 110 of the high-voltage power supply device 100 from a main control unit 80 that controls and manages the overall operation of printer 1. As a result, the control device 110 starts the output control flow of FIG. 5 to set the output voltage Vo of the voltage applying circuit 200, that is, a target value of application voltage applied to the wire 53 of each of the chargers 50B, 50Y, 50M, and 50C to 6 kV (step S10).

Subsequently, the control device 110 adjusts the duty ratio of PWM signal S1 on the basis of the input voltage (e.g., the voltage value detected by voltage detection circuit 240) of A/D port P1. Therefore, the primary voltage of the transformer Tr is controlled by the trans-drive circuit 220, such that output voltage Vo of the voltage applying circuit 200 is adjusted to the target value, 6 kV (e.g., S20, constant-voltage control).

When the output voltage Vo is stabilized at the target value, 6 kV, the control device 110 calculates the current sum Ig4 of the grid currents Ig from the input voltage of A/D port P2. In addition, the current sum Ig4 of the grid currents Ig is compared with the reference value to judge whether the current sum Ig4 is higher than the reference value (step S30). In this example, since the reference value is set to 1, it is judged whether the current sum Ig4 of the grid currents Ig is equal to or higher than 1 mA.

In the judgment processing of step S30, if current sum Ig4 of the grid currents Ig is less than the reference value, it is determined that the judgment is NO. If the judgment in step S30 is NO, steps S40 and S50 are sequentially performed in control device 110. First, in step S40, it is judged whether output voltage Vo of voltage applying circuit 200 is equal to or higher than the upper limit.

The judgment is employed to prevent output voltage Vo from being excessively increased. In this example, the upper limit of the output voltage Vo is set to 7.5 kV and if output voltage Vo is lower than the upper limit, the judgment in step S30 is NO, and then, step S50 is performed by the control device 110.

In step S50, the target value of output voltage Vo is changed and boosted up by 200 V. As a result, the target value of the application voltage is changed from 6 kV to 6.2 kV.

Thereafter, as described above, in step S20, the output voltage Vo of the voltage applying circuit 200 is adjusted, and in step S30, it is judged again whether the current sum Ig4 of the grid current Ig is higher than the reference value, 1 mA. In addition, if the judgment in step S30 is NO, the target value of the application voltage is changed again and boosted up by 200 V in step S50 after the judgment of step S40.

Further, if the current sum Ig4 of grid current Ig is higher than the reference value, 1 mA, the judgment is YES in step S30. If the judgment is YES in step S30, the initial control ends and the main control is performed after step S60.

Main Control: Constant-Current Control

When control device 110 executes the main control, control device 110 controls output voltage Vo of voltage applying circuit 200 so that the current sum Ig4 of the grid currents Ig is a constant current having the reference value, 1 mA. Specifically, the control device 110 controls the output voltage Vo by adjusting the duty ratio of a PWM signal S1 outputted from PWM port A on the basis of the input voltage level of A/D port P2. Meanwhile, although the current sum Ig4 is subjected to the constant-current control using the reference value, 1 mA, in this example, the current sum Ig4 may be subjected to the constant-current control using other values, such as, for example, 1.2 mA, as long as the current sum Ig4 is equal to or higher than the reference value.

Following step S60, it is judged whether output voltage Vo of the voltage applying circuit 200 is equal to or higher than the upper limit, 7.5 kV in step S70. If output voltage Vo is lower than the upper limit, the process for step S80 is performed, and thereafter, in step S90, a process of storing output voltage Vo is performed in the control device 110.

Thereafter, the process proceeds to step S100 and it is judged whether a process of applying high voltage to charger 50 is completed by the control device 110. Since it is judged that the application process of high voltage is completed when printer 1 completes the print processing, the judgment in step S100 is NO during the printing processing, and the process returns to step S60.

As described above, until the application process of high voltage is completed, the processes of steps S60 to S100 are repeatedly performed except for the case that the judgment is No in steps S70 and S80, and the current sum Ig4 of the grid currents Ig is continually subjected to the constant-current control using the reference value, 1 mA.

As such, when current sum Ig4 of grid currents Ig is subjected to the constant-current control using the reference value, 1 mA, the grid current Ig of each of the chargers 50B, 50Y, 50M, and 50C has a current value of approximately 205 μA although the current value is somewhat varied. As a result, the discharge current If (see, e.g., FIG. 8 of the second exemplary embodiment) of an appropriate amount sufficient to avoid the deterioration of an image quality flows from each charger 50 to each photosensitive drum 41, such that the charge amount of each photosensitive drum 41 may be equal to or higher than a target level.

If the printer 1 terminates the print processing, the control device 110 judges that the application process of high voltage to each of the chargers 50B, 50Y, 50M, and 50C is completed. As a result, when the judgment of step S100 is performed, the judgment is YES, thereby a series of processes are completed first. In addition, when print data D outputted from the higher-level device is again received in printer 1, the print processing start command is given to control device 110 of the high-voltage power supply device 100 from the main control unit 80. As a result, the sequential processes are performed from step S10 again, such that in the main control, output voltage Vo of voltage applying circuit 200 is controlled so that the current sum Ig4 of the grid currents Ig becomes the constant current having the reference value, 1 mA.

Meanwhile, during the constant-current control, the output voltage Vo of the voltage applying circuit 200 tends to increase, because when the wire 53 gets dirty by the use, grid current Ig decreases, and as a result, control device 110 controls the level of the output voltage Vo of the voltage applying circuit 200 to be increased to supplement the decreased current amount. If the output voltage is excessively higher, there is a possibility that the wire 53 of the charger 50 will cause an abnormal discharge.

In view of the above, it is judged in step S70 whether the output voltage Vo of the voltage applying circuit 200 is equal to or higher than the upper limit in this exemplary embodiment. In addition, when the output voltage Vo is higher than the upper limit, the judgment is YES in step S70, and thereafter, the process proceeds to step S110. Similarly, the process proceeds to step S110 if the judgment is YES in step S40, that is, output voltage Vo is higher than the upper limit in the initial control step. In step S110, a message for urging an operator to clean the wire 53 of each charger 50 is notified. Specifically, the control device 110 displays a message for urging the operator to clean the wire on a monitor (not shown) provided in the printer 1.

If the message for urging the operator to clean the wire is displayed, the operator who sees the message may remove contaminants of the wire 53 of each charger 50 by using the wire cleaner 57. Thereafter, since the wire 53 of each charger 50 may be easily discharged, the output voltage Vo of the voltage applying circuit 200 can be decreased, thereby avoiding the abnormal discharge of the wire 53 of each charger 50 in advance.

In some cases, the operator may voluntarily clean only wires 53 of some chargers 50. In this case, since the current sum Ig4 of grid currents Ig is made into a constant current, if the wires are different from each other in contamination level, a current value of grid current Ig varies significantly and such variation is undesirable.

In this regard, in the present exemplary embodiment, the control device 110 judges whether the output voltage Vo tends to decrease by comparing the output voltage Vo with previous output voltage Vo in step S80. When the operator voluntarily cleans wire 53 of charger 50, wire 53 is easily discharged, and as a result, the output voltage Vo is lower than the previous output voltage Vo. Therefore, the judgment is YES in step S80, and the process proceeds to step S110.

As a result, similar the case described above, a message for urging the operator to clean the wire 53 of each charger 50 is notified. As a result, even when the operator voluntarily cleans merely wires 53 of some chargers 50, the operator cleans the rest of wires 53 by using wire cleaner 57, thereby avoiding the situation that only some of the wires 53 are cleaned.

As described above, the printer 1 shares a single voltage applying circuit 200 with the chargers 50B, 50Y, 50M, and 50C. Therefore, the number of components can be reduced as compared with a case in which the exclusive voltage applying circuits 200 are provided for the chargers 50B, 50Y, 50M, and 50C, respectively.

In the main control step, since the current sum Ig4 of the grid currents Ig is subjected to the constant-current control using the reference value, 1 mA, each grid current Ig has the current value of approximately 250 μA although the current value is somewhat varied. As a result, the discharge current If of an appropriate amount sufficient to avoid the deterioration of the image quality flows from each charger 50 to each photosensitive drum 41, such that the charge amount of each photosensitive drum 41 may become equal to or higher than the target level. Accordingly, the image quality can be prevented from deteriorating due to the shortage of the charge amount. Further, for example, when each of the grid currents Ig is detected, the current detecting unit is required for each grid electrode 55. In this example, since the current sum Ig4 of the grid currents Ig is detected, only one current detecting unit 260 is used. Accordingly, the circuit can be configured by the small number of components.

Further, in the exemplary embodiment, since the grid voltages of all chargers 50B, 50Y, 50M, and 50C are made into a constant voltage through one constant-voltage circuit 250, the circuit can be configured with smaller number of components as compared with a case where constant-voltage circuit 250 is provided for each of chargers 50B, 50Y, 50M, and 50C. In addition, when constant-voltage circuit 250 is commonly used, the voltage levels of grid electrodes 55 of chargers 50 are the same with each other, and as a result, the charged voltages of each of photosensitive drums 41 can be controlled by using approximately the same charged voltage.

Second Exemplary Embodiment

The second exemplary embodiment of the present disclosure will be described with reference to FIGS. 7 to 9.

In the first exemplary embodiment, the current sum Ig4 of the grid currents Ig is subjected to the constant-current control using the reference value (e.g., 1 mA). In the second exemplary embodiment, a current sum Iw4 of wire currents Iw that flows on the wires 53 of the chargers 50 is subjected to the constant-current control using a reference value (e.g., 1.1 mA).

In order to detect the current sum Iw4 of the wire currents Iw, a current detecting resistor may be provided on a current return path Lr for the voltage applying circuit 200. More specifically, referring to FIG. 7, one end of the secondary wire of transformer Tr of output circuit 230 of voltage applying circuit 200 is adapted to as an output terminal U, and the wires 53 of the chargers 50B, 50Y, 50M, and 50C are commonly connected to an output line Lo drawn from output terminal U. Grid electrode 53 of each of the chargers 50B, 50Y, 50M, and 50C is connected to the ground GND through the connection line L1. In addition, a constant-voltage circuit 250 constituted by three constant-voltage elements (e.g., zener diodes) that are connected in series is provided on the connection line L1.

Meanwhile, the other end of the secondary wire of transformer Tr is connected to an output terminal (e.g., 5V) of a low-voltage power supply circuit 280 through connection line Lr.

As described above, all of the currents that flow out to the chargers 50 from the output terminal U of the voltage applying circuit 200, that is, current sum Iw4 of wire currents Iw all return to the voltage applying circuit 200 through the connection line Lr. That is, connection line Lr serves as a common return path for returning wire currents Iw of each of the chargers 50 to the voltage applying circuit 200.

Figure 7:
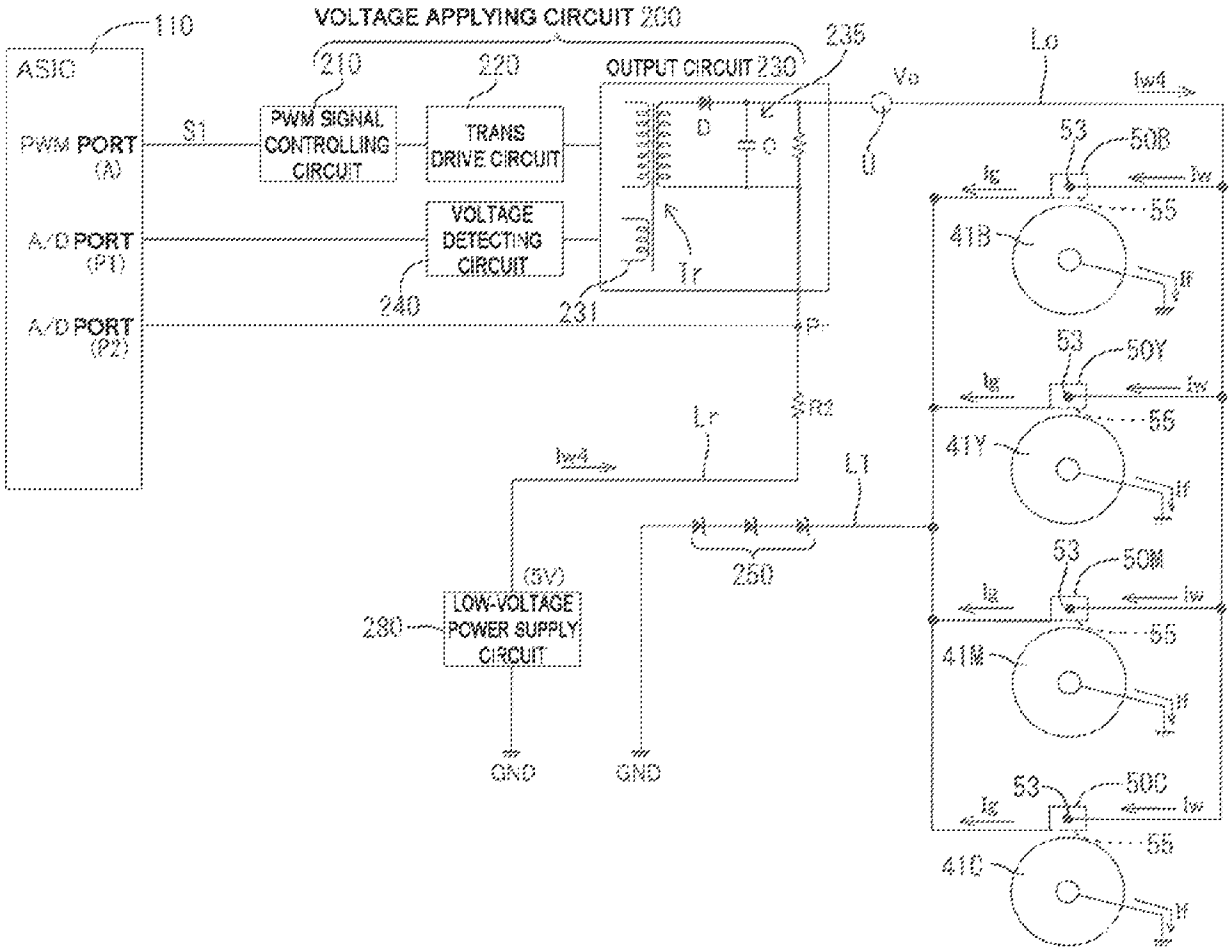
FIG. 7 is a block diagram showing an electrical configuration of a high-voltage power supply device according to a second exemplary embodiment of the present disclosure.
Figure 8:
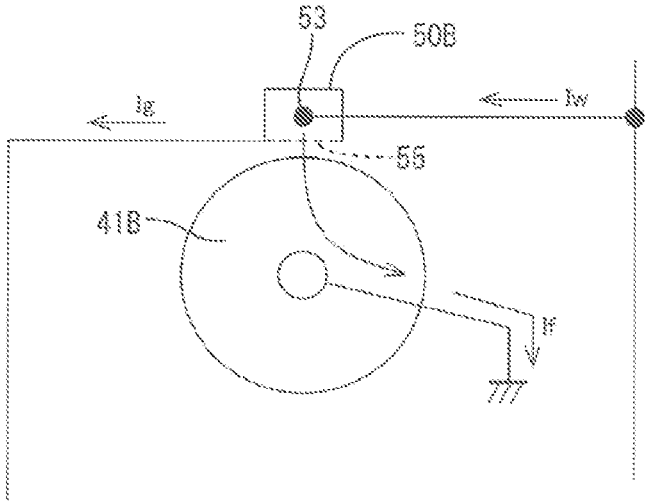
FIG. 8 is an enlarged diagram of a part of FIG. 7.
Figure 9:
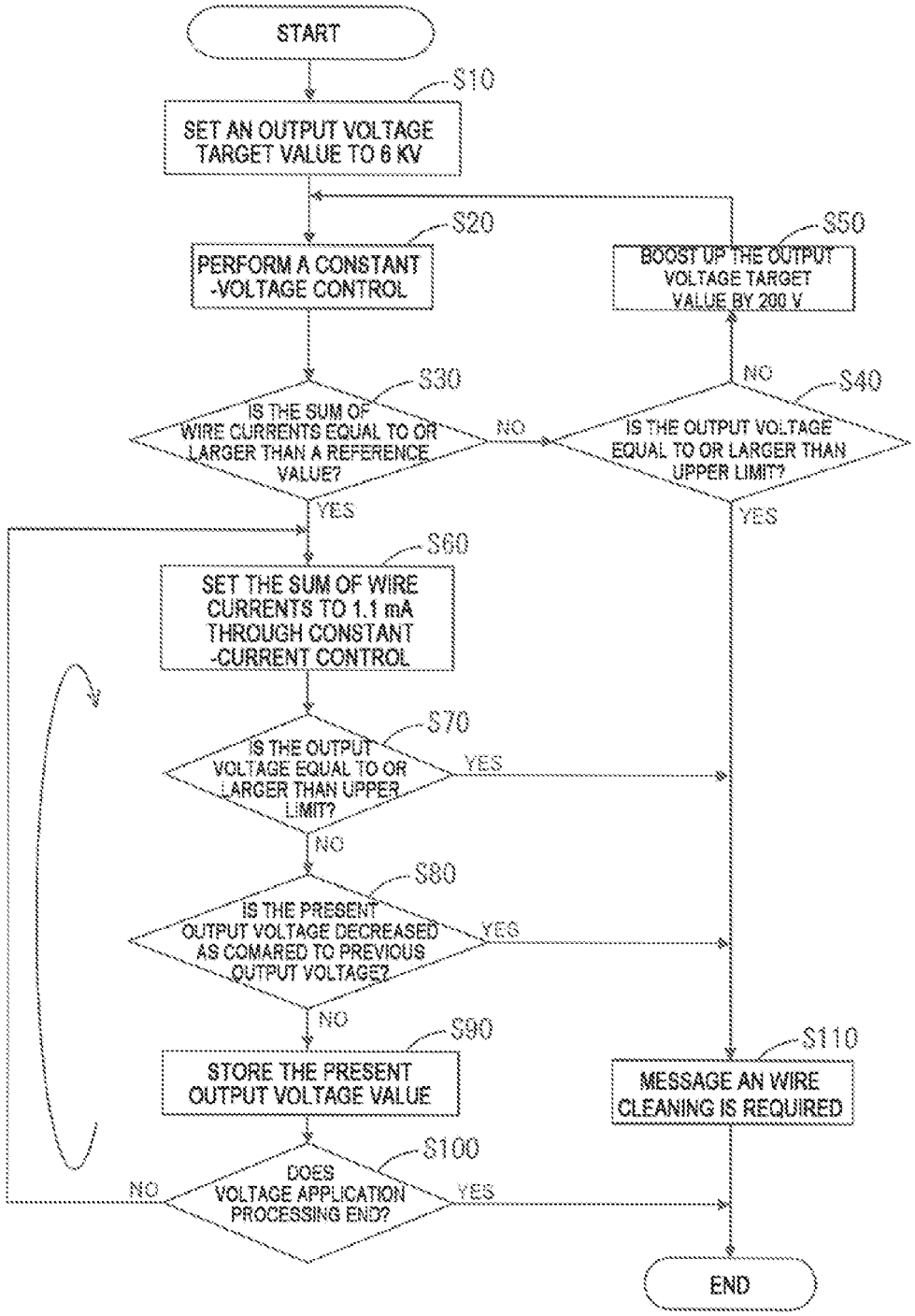
FIG. 9 is a diagram showing a modified example of the output control flow of the voltage applying circuit.

In addition, wire currents Iw flow by being divided into grid current Ig that flows to the grid electrode and discharge current If that flows to photosensitive drum 41 at a ratio of approximately 9:1, as shown in FIGS. 7 and 8. However, since both currents Ig and If flow into the ground GND, wire currents Iw in which both currents Ig and If are joined flow on a common return path Lr drawn from the output terminal of low-voltage power supply circuit 280.

A second resistor R2 serving as current detecting unit 260 is provided on the common return path Lr. The Second resistor R2 is connected to each A/D port P2 provided in the control device 110 through the signal line. As described above, a voltage which is in proportion to the magnitude of the current (e.g., current sum Iw4 of wire currents Iw) that flows on the common return path Lr is inputted into A/D port P2. As a result, by referring to the input voltage of port P2, the magnitude of the current sum Iw4 of the wire currents Iw can be detected in the control device 110.

Meanwhile, the common return path Lr is drawn from the output terminal of the low-voltage power supply circuit 280 because the control device 110 cannot read a minus voltage and the voltage level is increased in order for that voltage of a voltage withdrawing point Pr does not become minus voltage.

In the second exemplary embodiment, the output control flow of the voltage applying circuit 200 executed by control device 110 is the same as the output control flow of the first exemplary embodiment except that the current sum Ig4 of the grid currents Ig is substituted by the current sum Iw4 of the wire currents Iw. As shown in FIG. 9, the output control flow is performed by a two-step control including the initial control (e.g., the constant-voltage control: steps S10 to S50) performed just after the print processing starts and the main control (e.g., the constant-current control: steps S60 to S120) performed until the print processing is completed after the initial control. In addition, in the main control step, the current sum Iw4 of the wire currents Iw is subjected to the constant-current control using the reference value, 1.1 mA by the control device 110.

As such, when the current sum Iw4 of the wire currents Iw is subjected to the constant-current control using the reference value, 1.1 mA, each wire current Iw has a current value of approximately 270 to 280 μA although the current value is somewhat varied. As a result, the discharge current If of the appropriate amount sufficient to avoid the deterioration of the image quality flows from each charger 50 to each photosensitive drum 41, such that the charge amount of each photosensitive drum 41 may be made equal to or higher than the target level. Accordingly, the image quality can be prevented from deteriorating due to the shortage of the charge amount.

Third Exemplary Embodiment

Figure 10:
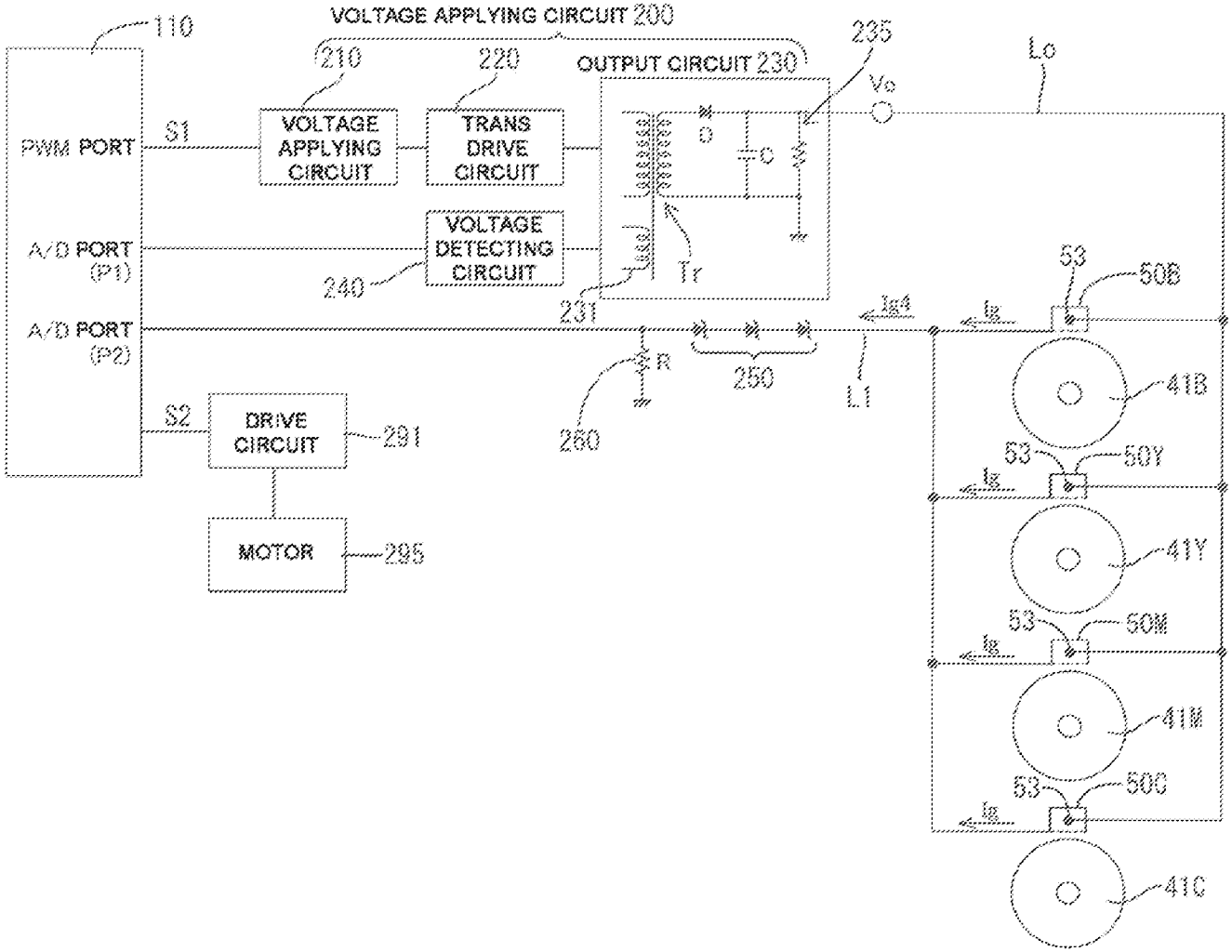
FIG. 10 is a block diagram showing an electrical configuration of a high-voltage power supply device according to a third exemplary embodiment of the present disclosure.

Third exemplary embodiment of the present disclosure will be described with reference to FIG. 10. The third exemplary embodiment automatizes the cleaning of the wires 53 and further includes a motor drive circuit 291 and a motor 295 in addition to the electrical components of the first exemplary embodiment. The motor 295 serves as a driving source of a reciprocating device (not shown) that allows wire cleaner 57 (e.g., the 'cleaning unit' of the present disclosure) to reciprocate along wires 53.

The motor drive circuit 291 controls motor 295 on the basis of a control signal S2 outputted from the control device 110. In addition, the control device 110, for example, the drives motor 295 by giving the control signal S2 to the motor drive circuit 291 for every 200 print sheets. As a result, the reciprocating device is actuated, such that the wire cleaner 57 automatically cleans the wires 53 of the chargers 50.

Thus, since the wire 53 of each charger 50 can be kept clean at all times, the image quality does not deteriorate even though the number of print sheets increases over the period of time usage. Meanwhile, although only one motor drive circuit 291 and one motor 295 are shown in FIG. 10, the wire 53 is provided for each charger 50, and thus, the motor drive circuit 291 and the motor 295 also need to be provided for each charger 50. For example, for every 200 print sheets, the control device 110 drives each motor 295 by giving the control signal S2 to each motor drive circuit 291 to automatically clean the wires 53 of the chargers 50 by using each of the wire cleaners 57 at one time, respectively. Meanwhile, automatic cleaning timings of wires 53 may not completely be the same.

Other Exemplary Embodiment

The present disclosure is not limited to the exemplary embodiments described by the technologies and drawings, but for example, the following exemplary embodiment also belongs to the scope of the present disclosure.

Figure 11:
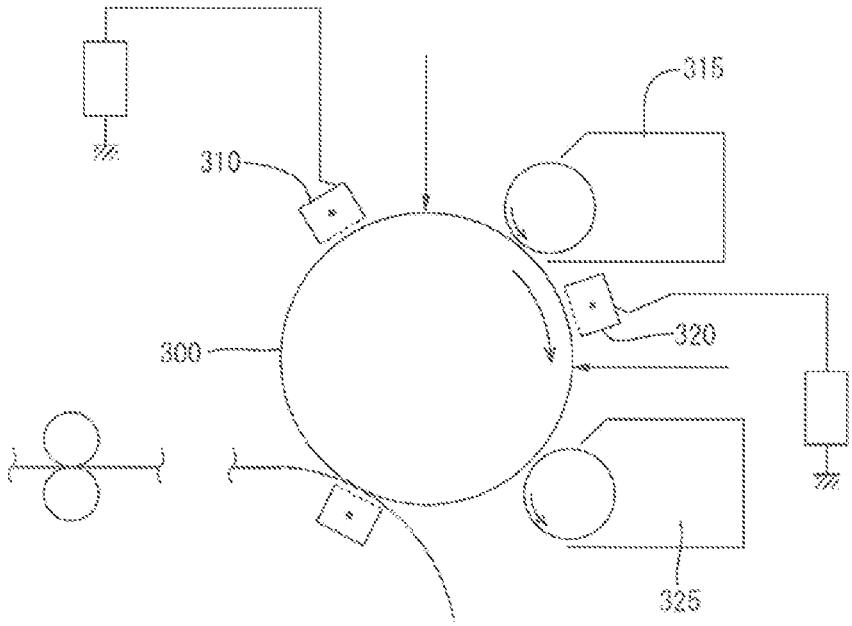
FIG. 11 is a diagram showing another configuration example of the printer.

(1) In the first to third exemplary embodiments, as a configuration example of the printer 1, the printer 1 having one charger 50 corresponding to one photosensitive drum 41 (e.g., printer 1 having photosensitive drum 41 for each color) has been described. The present disclosure may be applied to a printer 1 in which plural chargers 310 and 320 are placed to correspond to one photosensitive drum 300 as shown in FIG. 11 (e.g., the printer 1 in which toner images of respective colors are superposed on the photosensitive drum 300 and thereafter, are transferred on the sheets at one time). Meanwhile, reference numeral 315 in FIG. 11 represents a process unit (e.g., a developer) that makes up a group with the charger 310 and reference numeral 325 represents a process unit that makes up a group with the charger 320.

In the first exemplary embodiment, the current sum Ig4 of the grid currents Ig is subjected to the constant-current control using the reference value, 1 mA. It was intended to set the grid current Ig of each charger 50 to the reference value of approximately 250 μA. The grid current Ig of each charger 50 can be made equal to or higher than the reference value by performing a constant-voltage control on the output voltage Vo of the voltage applying circuit 200 instead of the constant-current control. That is, the output voltage Vo may be subjected to the constant-voltage control with a voltage value with which the current sum Ig4 (Iw4 is also the same) of the grid currents Ig may be made higher than the reference value, 1 mA.

Further, in the case in which output voltage Vo is subjected to the constant-voltage control, when the degree of wire contamination is changed, the changed contamination degree is shown as a change of the current sum Ig4 (Iw4 is also the same). For example, when the wires are becoming contaminated, the current sum Ig4 tends to accordingly decrease, such that a reduction level of current sum Ig4 is substantially in proportion to a progressed degree of the wire contamination. Accordingly, the data for current sum Ig4 (e.g., the input value of A/D port P2) is stored at the time of detecting the current sum Ig4 and thereafter, a difference between the present current sum Ig4 and the current sum Ig4 at the time of previous detection is acquired. In addition, when the difference of the current sums Ig4 becomes higher than an acceptable value, if a message urging the operator to clean each wire 53 is notified to the operator by the control device 110, the cleaning can be performed when the wire contamination is rapidly progressed.

Figure 12:
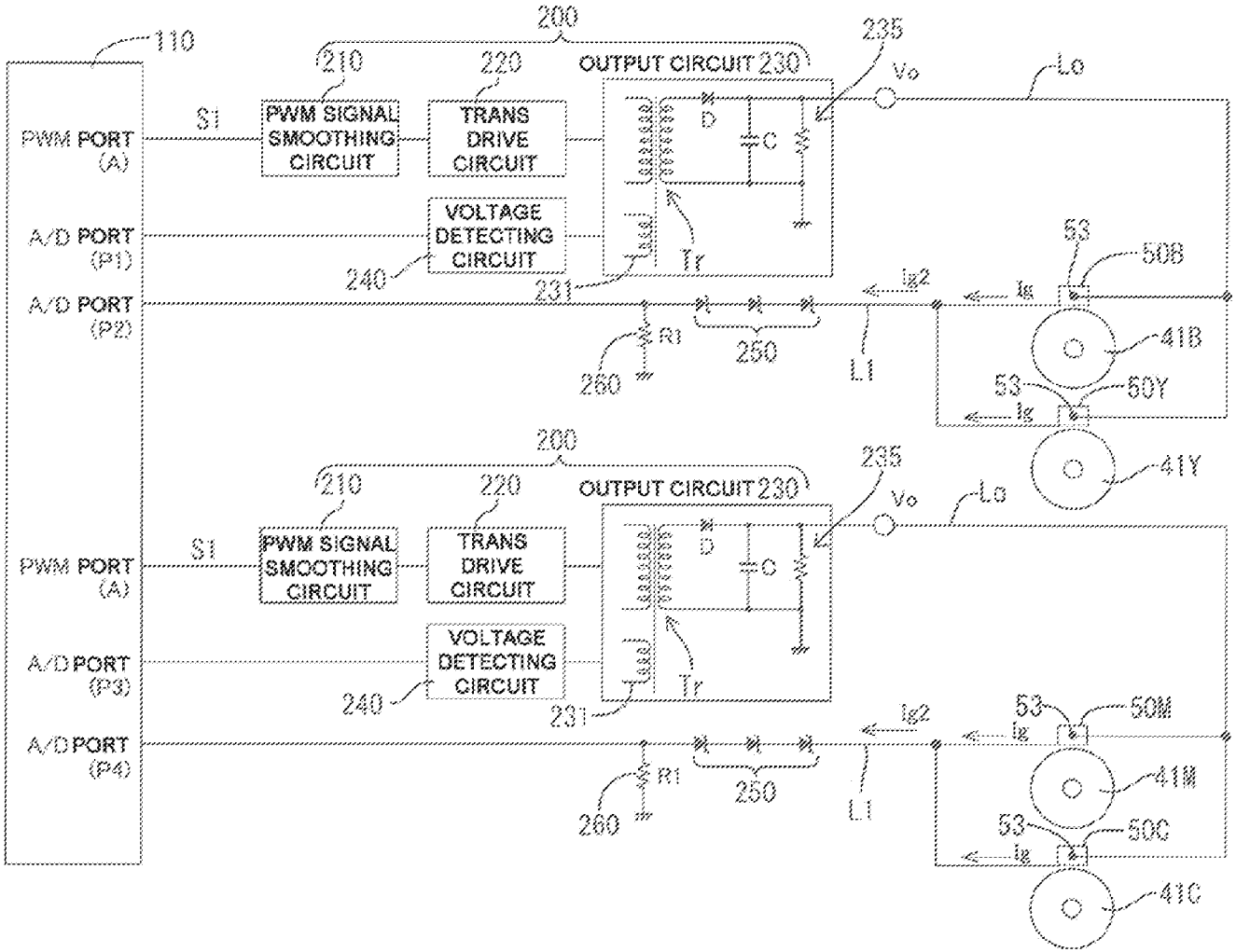
FIG. 12 is a block diagram showing an electrical configuration when the high-voltage power supply device is divided into two systems.

(3) In the first to third exemplary embodiments, there is described a configuration example in which the four chargers 50 are commonly connected to the output line Lo of the voltage applying circuit 200. All of the four chargers do not need to be commonly connected to voltage applying circuit 200 and each two sets of chargers may be commonly connected to each voltage applying circuit by dividing the voltage applying circuit into two systems shown in FIG. 12. In addition, if the voltage applying circuit is divided into two systems as shown in FIG. 12, a current sum Ig2 of the grid currents Ig may be detected for each system to individually constant-current control respective current sum Ig2.

(4) In the second exemplary embodiment, as one example of charger 50, Scorotron charger having grid electrode 55 is described, but a corona discharge type charger may also be applied and a Scorotron charger may also be used without the grid electrode.

(5) In the first to third exemplary embodiments, as one example of the constant-voltage element, the zener diode is described, but a varistor may be used as well. Further, the resistance detection type current detecting unit is described as one example of the current detecting unit 260, but a current sensor using a hall element may also be used.

What is claimed is:

1. An image forming apparatus, comprising:

at least one photosensitive element;

a plurality of chargers configured to charge the at least one photosensitive element;

a voltage applying circuit commonly connected to the plurality of chargers and configured to apply a voltage to the plurality of chargers;

a current detecting unit configured to detect a current sum of currents of the plurality of chargers; and a control device configured to control the voltage applying circuit so that the current sum detected by the current detecting unit becomes equal to or larger than a reference value, wherein the plurality of chargers are Scorotron chargers having wires and grid electrodes, wherein the grid electrode of each of the Scorotron chargers is connected to ground through a common connection line, and wherein the current detecting unit includes a resistor provided at the common connection line and a constant-voltage element provided at the common connection line between the plurality of chargers and the resistor, the current detecting unit configured to detect a voltage at a point between the resistor and the constant-voltage element to detect the current sum.

2. The image forming apparatus according to claim 1, wherein the control device controls an output voltage of the voltage applying circuit so that the current sum becomes a constant current that is equal to or larger than the reference value.

3. The image forming apparatus according to claim 1, wherein wire current that flows on the wire provided in each of the chargers is adapted to be returned to the voltage applying circuit through a common return path, and the current detecting unit includes a resistor provided on the common return path and is configured to detect as the current sum a current sum of the wire current of each of the chargers.

4. The image forming apparatus according to claim 2, further comprising a voltage detecting circuit configured to detect the output voltage of the voltage applying circuit, wherein the control device provides a message notifying an operator to clean a wire if the output voltage detected by the voltage detecting circuit is decreased as compared to the output voltage detected at a previous detection time.

5. The image forming apparatus of according to claim 1, further comprising:

a voltage detecting circuit configured to detect an output voltage of the voltage applying circuit, wherein the control device performs a constant-voltage control of the output voltage of the voltage applying circuit at a voltage level where the current sum becomes equal to or larger than the reference value.

6. The image forming apparatus according to claim 5, wherein the plurality of chargers are Scorotron chargers having wires and grid electrodes, and the grid electrode of each of the Scorotron chargers is connected to a ground through a common connection line including a constant-voltage element.

7. The image forming apparatus according to claim 6, wherein the current detecting unit includes a resistor provided on the common connection line and is configured to detect as the current sum a current sum of grid current of each of the Scorotron chargers.

8. The image forming apparatus according to claim 5, wherein wire current that flows on the wire provided in each of the chargers is adapted to be returned to the voltage applying circuit through a common return path, and the current detecting unit includes a resistor provided on the common return path and is configured to detect as the current sum a current sum of the wire current of each of the chargers.

9. The image forming apparatus according to claim 5, wherein the control device provides a message notifying an operator to clean a wire provided in each of the chargers if a difference between the current sum detected by the current detecting unit and a current sum detected previously by the current detecting unit exceeds an acceptable value.

10. The image forming apparatus according to claim 1, wherein a wire is provided in each of the chargers, a cleaning unit is provided in each of the wires, and the control device cleans each of the wires by actuating each of the cleaning units for a predetermined period.

11. The image forming apparatus according to claim 1, wherein a plurality of the photosensitive elements is provided to correspond to the plurality of chargers.

12. The image forming apparatus according to claim 1, wherein the plurality of chargers is connected to ground through a common connection line, the current detecting unit includes a resistor provided on the common connection line and is configured to detect a voltage at one end of the resistor to detect the current sum.

* * * * *